US007927095B1

(12) United States Patent
Chorpening et al.

(10) Patent No.: US 7,927,095 B1
(45) Date of Patent: Apr. 19, 2011

(54) TIME VARYING VOLTAGE COMBUSTION CONTROL AND DIAGNOSTICS SENSOR

(75) Inventors: Benjamin T. Chorpening, Morgantown, WV (US); Jimmy D. Thornton, Morgantown, WV (US); E. David Huckaby, Morgantown, WV (US); William Fincham, Fairmont, WV (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 744 days.

(21) Appl. No.: 11/864,998

(22) Filed: Sep. 30, 2007

(51) Int. Cl.
*F23N 5/00* (2006.01)

(52) U.S. Cl. ..... 431/66; 431/12; 431/24; 431/25; 431/75; 431/77; 431/78; 700/274; 73/335.04

(58) Field of Classification Search ..... 431/12, 431/24, 25, 75, 77, 78, 66; 700/274; 340/579; 73/335.04
See application file for complete search history.

(56) References Cited

U.S. PATENT DOCUMENTS 2,632,102 A * 3/1953 Jellinek ..... 307/653
2,737,643 A * 3/1956 Marsden, Jr. ..... 340/579
2,870,329 A * 1/1959 Aubert ..... 307/653
3,627,458 A * 12/1971 Wade ..... 431/25
4,082,994 A * 4/1978 Newton ..... 324/438
4,288,741 A * 9/1981 Dechene et al. ..... 324/664
4,343,360 A * 8/1982 Ginsburgh et al. ..... 166/250.15
4,343,361 A * 8/1982 Ginsburgh et al. ..... 166/250.15
4,363,468 A * 12/1982 Noe ..... 266/76
4,527,125 A * 7/1985 Miyanaka et al. ..... 307/653
4,555,941 A * 12/1985 Fathauer et al. ..... 73/304 C
4,710,125 A * 12/1987 Nakamura et al. ..... 431/22
4,981,033 A * 1/1991 Yang ..... 73/112.01
5,439,374 A * 8/1995 Jamieson ..... 431/25
5,687,082 A * 11/1997 Rizzoni ..... 701/111
5,722,822 A * 3/1998 Wilson et al. ..... 431/25
5,899,683 A * 5/1999 Nolte et al. ..... 431/25
5,952,930 A * 9/1999 Umeda et al. ..... 340/579
5,973,503 A * 10/1999 Kuipers et al. ..... 324/698
6,084,518 A * 7/2000 Jamieson ..... 340/577
6,113,384 A * 9/2000 Sebastiani ..... 431/12

(Continued)

OTHER PUBLICATIONS

He R, Beck C M, Waterfall R C and Beck M S 1993 "Development of capacitance measurement towards tomographic imaging of flames" Sensors VI: Technology, Systems and Applications ed K T V Grattan and A T Augousti (Bristol: Adam Hilger) pp. 365-368.*

(Continued)

*Primary Examiner* — Kenneth B Rinehart
*Assistant Examiner* — Jorge Pereiro
(74) *Attorney, Agent, or Firm* — James B. Potts; Mark P. Dvorscak

(57) ABSTRACT

A time-varying voltage is applied to an electrode, or a pair of electrodes, of a sensor installed in a fuel nozzle disposed adjacent the combustion zone of a continuous combustion system, such as of the gas turbine engine type. The time-varying voltage induces a time-varying current in the flame which is measured and used to determine flame capacitance using AC electrical circuit analysis. Flame capacitance is used to accurately determine the position of the flame from the sensor and the fuel/air ratio. The fuel and/or air flow rate (s) is/are then adjusted to provide reduced flame instability problems such as flashback, combustion dynamics and lean blowout, as well as reduced emissions. The time-varying voltage may be an alternating voltage and the time-varying current may be an alternating current.

39 Claims, 10 Drawing Sheets

U.S. PATENT DOCUMENTS

| | | | | |
|---|---|---|---|---|
| 6,429,020 | B1 * | 8/2002 | Thornton et al. | 436/153 |
| 6,703,847 | B2 * | 3/2004 | Venter et al. | 324/663 |
| 6,807,438 | B1 * | 10/2004 | Brun Del Re et al. | 600/372 |
| 6,839,620 | B1 * | 1/2005 | Koehler et al. | 701/108 |
| 6,887,069 | B1 * | 5/2005 | Thornton et al. | 431/12 |
| 6,985,080 | B2 * | 1/2006 | Kociecki et al. | 340/577 |
| 6,989,678 | B2 * | 1/2006 | Venter et al. | 324/663 |
| 7,197,880 | B2 * | 4/2007 | Thornton et al. | 60/779 |
| 7,523,673 | B1 * | 4/2009 | Chorpening et al. | 73/861.09 |
| 7,559,234 | B1 * | 7/2009 | Chorpening et al. | 73/112.01 |
| 2003/0062908 | A1 * | 4/2003 | Venter et al. | 324/661 |
| 2004/0124856 | A1 * | 7/2004 | Venter et al. | 324/664 |
| 2004/0174265 | A1 * | 9/2004 | Kociecki et al. | 340/577 |
| 2005/0021216 | A1 * | 1/2005 | Koehler et al. | 701/108 |
| 2005/0235742 | A1 * | 10/2005 | Bengtsson et al. | 73/116 |
| 2005/0264219 | A1 * | 12/2005 | Dhindsa et al. | 315/111.21 |
| 2005/0274116 | A1 * | 12/2005 | Thornton et al. | 60/776 |
| 2006/0257801 | A1 * | 11/2006 | Chian | 431/18 |
| 2006/0257804 | A1 * | 11/2006 | Chian et al. | 431/24 |

OTHER PUBLICATIONS

R.C. Waterfall, R. He, N.B. White and C.M. Beck, "Combustion imaging from electrical impedance measurements", Meas Sci Technol 7 1996,pp. 369-374.*

Winkler et al., "Ion Current Measurements in Natural Gas Flames", Proceedings of the European Combustion Meeting 2007 (Apr. 2007).

* cited by examiner

TIME VARYING VOLTAGE COMBUSTION CONTROL AND DIAGNOSTICS SENSOR

STATEMENT REGARDING FEDERALLY SPONSORED RESEARCH OR DEVELOPMENT

The United States Government has rights in this invention pursuant to the employer-employee relationship of the U.S. Department of Energy and the inventors.

FIELD OF THE INVENTION

This invention relates generally to the monitoring and control of an industrial combustion process, and is particularly directed to an improved sensor arrangement and method for monitoring and diagnosis of the combustion process in a lean-premix gas turbine combustor to allow for the exercise of real-time control over the combustion process.

BACKGROUND OF THE INVENTION

The requirement to reduce pollutant emissions has motivated turbine manufacturers to develop advanced combustion technologies. Although capable of producing ultra-low emissions (<10 ppm NOx), these advanced combustors suffer from flame instability problems such as flashback, combustion dynamics, and lean blowout. These problems cause reduced component life, unplanned shutdowns, and potentially catastrophic engine damage. Flame instabilities can be triggered by weather changes, fuel composition changes, operational changes, and component wear. To avoid these costly problems, turbine manufacturers have typically developed operating margins at the expense of ultra-low emissions. An alternative strategy is to perform in-situ combustion monitoring to provide the feedback necessary to minimize pollutant emissions while avoiding combustion instabilities. A combustion control and diagnostics sensor (CCADS) for gas turbines is the subject of U.S. Pat. Nos. 6,429,020; 6,887,069; and 7,096,722.

The CCADS flame ionization sensor 10 is based on two electrically isolated electrodes installed on the fuel nozzle as shown in FIG. 1. The electrode closest to the combustion zone is called the guard electrode 12, and the upstream electrode is called the sense electrode 14. When an equal voltage is applied to both electrodes, this arrangement facilitates current flow between the guard electrode 12 through the flame in the combustion region. As a result, the guard electrode signal can provide a wealth of important information about flame stability and the combustion process. A significant ionization current from the sense electrode 14 is produced only when the flame enters the upstream region of the fuel nozzle, i.e., during auto-ignition and/or flashback. The multi-sensing capability of CCADS flame ionization sensor 10 provides a simple, yet robust, in-situ monitoring sensor for combustion diagnostics.

However, quantifying important operating parameters for control of the turbine, e.g., equivalence ratio control, over the entire load range is complicated by flame instabilities. For example, during dynamic pressure oscillations at the peak pressure the flow through the system slows allowing the reaction to sometimes enter the premixing region of the fuel nozzle. The resulting dynamic changes in flame location complicate the CCADS measurement for equivalence ratio. Significant changes to the combustion conditions, such as those required for a large load change, i.e., change in bulk flow velocity, can result in flame variations that also affect the correlation of the CCADS measurements. In modern Dry Low NOx (DLN) gas turbines these types of changes are common while operating over the entire load range. To effectively implement CCADS for control of gas turbine combustors, an improved method for quantifying CCADS measurements is necessary.

Current CCADS measurements provided by the three aforementioned patents are achieved using a direct current (DC) measurement technique. A DC voltage is applied to the sensor electrodes resulting in a steady electric field projected into the combustion region, and the measured current through the flame is analyzed for combustion diagnostics. The extension of that invention provided by the present approach is to use advanced measurement techniques to mitigate the affects of flame instabilities as described in detail below. In accordance with an embodiment of the invention, numerous combinations of time-varying voltage (AC) and DC voltage can be applied to the sensor electrodes to generate a time-variant electric field projected into the combustion region. These advanced measurements provide additional information about flame electrical properties that can be used to improve sensor capability to accurately determine quantifiable measurements for combustion control applications.

OBJECTS AND SUMMARY OF THE INVENTION

Accordingly, it is an object of an embodiment of the invention to provide for real-time monitoring of, and the exercise of control over, the combustion process in an industrial combustion system.

It is another object of the present invention to apply a time-varying alternating voltage to the flame in a continuous combustion system for determining various combustion parameters such as the fuel/air ratio and the location of the flame in the combustion chamber, and for adjusting the fuel/air mixture for optimizing these parametric values and improving combustion efficiency and reducing noxious emissions.

Yet another object of the present invention is to apply conventional equivalent AC circuit analysis in terms of formulas and equations to a combustion process such as in lean-premixed gas turbine to allow for the determination and real-time adjustment of various combustion parameters to avoid flame instability problems such as flashback, combustion dynamics and lean blowout.

It is a further object of the present invention to address flame instabilities in a gas turbine combustor arising from weather changes, fuel composition changes, operational changes and component wear and tolerances by monitoring critical combustion parameters and allowing for real-time adjustment of these parameters for improved combustion efficiency and reduced emissions.

An additional object of this invention is to detect short-circuits and open circuits through the use of capacitance measurements when the electrode is energized with different combinations of direct current and alternating current for sensor self-diagnostics of the sensor electrode.

An embodiment of the invention is directed to a method and system for the real-time monitoring and control of a combustion process in the combustion zone of a combustion chamber, wherein a fuel/oxidant mixture characterized by a fuel/oxidant ratio is directed into the combustion zone via a fuel/oxidant inlet and is ignited for maintaining a combustion flame in the combustion zone, the method comprising the steps of providing a sensor having a first electrode disposed adjacent the combustion zone and an electrical ground, wherein the combustion flame is disposed a distance d from the first electrode; applying a time-varying alternating voltage to the first electrode and measuring an alternating electric current in the combustion flame between the first electrode and ground, wherein the current varies with the position of the flame from the first electrode within the combustion zone along a sensor axis; using equivalent AC circuit analysis with the measured alternating electric current between the first electrode and ground for determining the resistance and capacitance of the combustion flame; determining the distance d of the combustion flame from the first electrode of the sensor and the fuel/oxidant equivalence ratio of the fuel/oxidant mixture, wherein the distance d varies inversely with the capacitance of the combustion flame and the fuel/oxidant equivalence ratio varies directly with the capacitance of the combustion flame; and adjusting the fuel/oxidant mixture to adjust the distance d and the fuel/oxidant equivalence ratio for optimizing the combustion process by reducing flame instability and pollutant emissions. The oxidant is preferably air, but may also be composed of mixture of oxygen with diluents such as carbon dioxide, steam or nitrogen.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characteristics identify like elements throughout the various figures, in which:

DETAILED DESCRIPTION OF THE PREFERRED EMBODIMENTS

The operating equivalence ratio (ϕ) for a combustor using air as the oxidant is defined as $$\Phi = \frac{(\text{Fuel}/\text{Air})}{(\text{Fuel}/\text{Air})_{stoichiometric}} \tag{1}$$

Flame current measurements have been successfully correlated with the hydrocarbon concentrations in a number of applications. Most notable is the flame ionization detector (FID) used in gas chromatographs, where the relationship of current to hydrocarbon concentration is generally determined by $$i=r[C_nH_m]Q \tag{2}$$

where r is the charge per mole of hydrocarbon, $[C_nH_m]$ is the molar concentration of the hydrocarbons, and Q is the volumetric flow rate. The linearity of the FID measurements depends on the consistency of charge collection. This is accomplished by providing consistent inlet bulk flow velocity, a constant electric field across the flame, and using a hydrogen flame to ignite the inlet sample and maintain a stable flame.

Successful demonstrations of a flame ionization sensor for measuring the local fuel/air ratio in an internal combustion (IC) engine have also defined a linear relationship $$I = \frac{nV_{rz}\,v_d}{r} \tag{3}$$

where n is the charged species concentration indicative of the hydrocarbon concentration, $V_{rz}$ is the volume of reaction zone, $v_d$ is the drift velocity, and r is the distance between the reaction zone and the center of the electrode gap. This relationship works in an IC engine in part due to the low fluid velocities inside the piston during ignition and combustion, and the strong, localized electrostatic field generated at the spark plug. These factors combine to provide consistent charge collection from a limited region in the cylinder. Note that this system has significant differences from that encountered in a gas turbine, which has a rapidly moving flame in a high velocity flow.

The above relationships are closely linked to the basic physics for a conductor $$I=nqAvd \quad (4)$$

where n is the density of the charge carriers, q is their charge, A is the cross-sectional area, and $v_d$ is the drift velocity. Since the flame is considered a good conductor of electrical current, the standard physics for a conductor can be applied, in various forms as others have successfully demonstrated, to quantify the hydrocarbon concentration. In order to quantify the hydrocarbon concentration, fuel-to-air ratio, or equivalence ratio one must account for the changes that occur to the parameters affecting the current measurement. In the previous two examples consistent flame location is essential to the success of the measurement.

Figure 1:
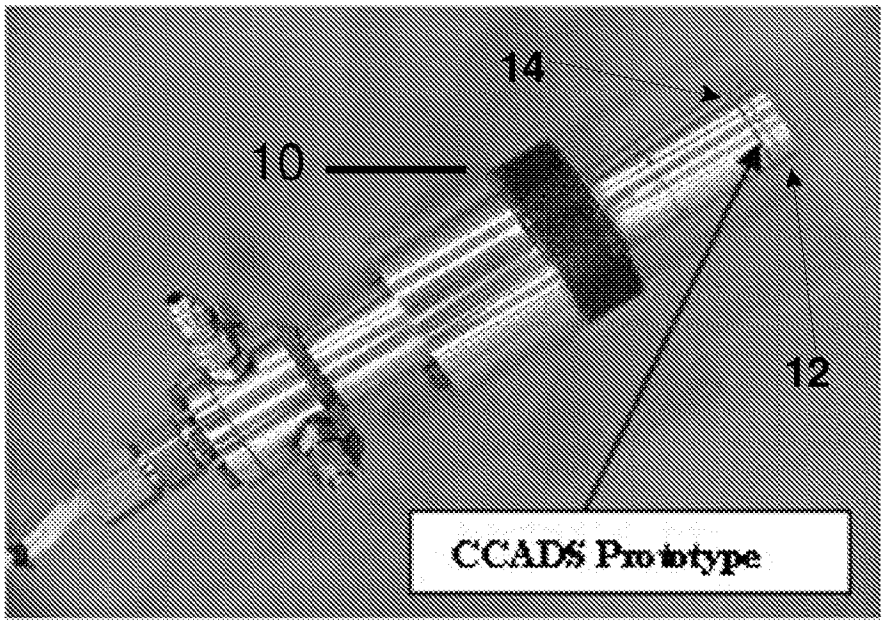
FIG. 1 is a side plan view of a combustion control and diagnostics flame ionization sensor for use in carrying out the present invention.
Figure 2:
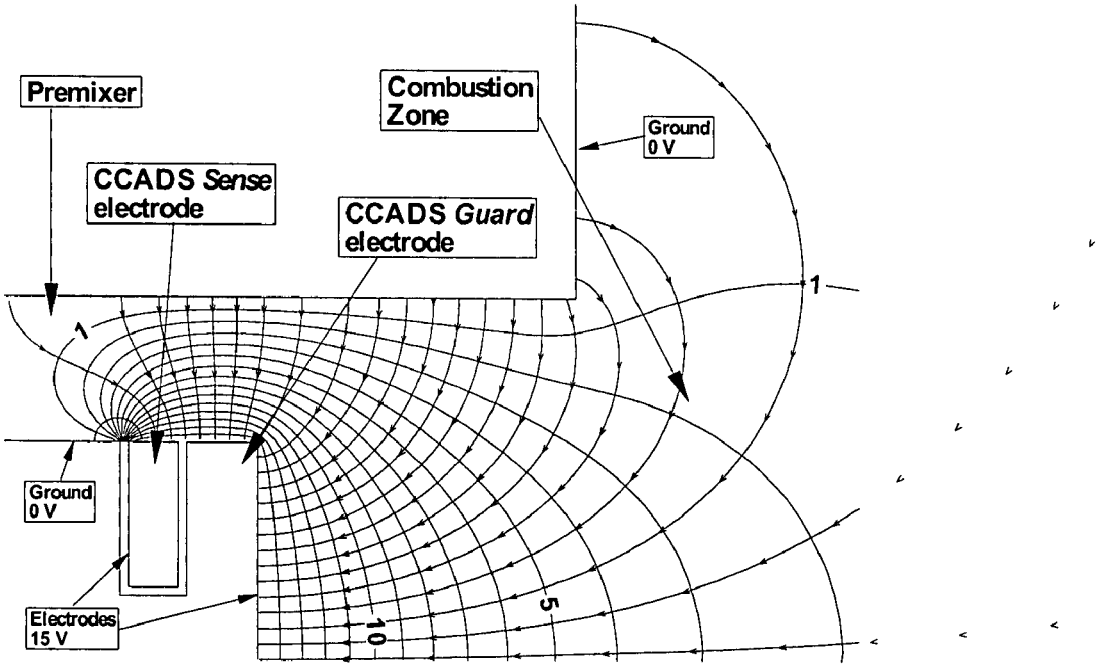
FIG. 2 is a partial cross-sectional view of the premixing passage and combustor regions of a lean premix combustion system illustrating the electric field from the combustion control and diagnostic sensor extending into the combustion region with equal DC voltages applied to the sensor's guard and sense electrodes, where the arrow represents the direction of gas flow into the combustor.
Figure 3:
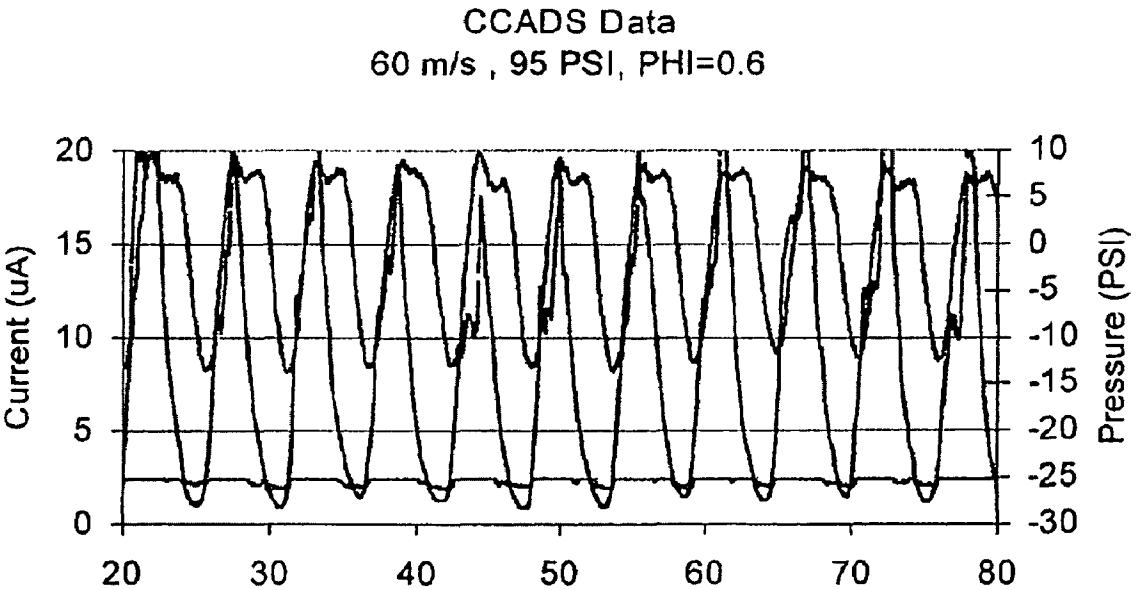
FIG. 3 is a graphic illustration of the exponential increase and decrease of the guard electrode current measurements during dynamic pressure oscillations indicative of the flame moving closer and farther away from the guard electrode in the direction of the voltage gradient.

For CCADS, the continuous combustion systems in gas turbines provide a continuous source of ionization for electrical current measurements. Applying an equal DC voltage to the electrodes results in an electric field from the guard electrode extending into the combustion region as illustrated in FIG. 2. The electric field is expressed as $$E=-\nabla V \quad (5)$$

where V is the voltage. It is noteworthy to point out that this electrostatic plot is for the prototype nozzle in the combustor at the NETL of the United States Department of Energy, and the electric field will change relative to changes in the electrode position and the surrounding combustion geometry (ground plane). The applied DC voltage results in a constant electric field at the electrode flame interface, and dynamic flame instabilities cause the flame to move axially in the combustion region resulting in an exponential increase or decrease in current, depending on the flame location. FIG. 3 is a time series graph illustrating the exponential increase and decrease of the guard current measurements respectively indicative of the flame moving closer and farther away from the guard electrode along the voltage gradient. Even with a stable flame, increases in the bulk flow velocity, i.e., load changes, can force the reaction farther downstream away from the guard electrode, resulting in a lower current measurement at the same equivalence ratio. To accurately quantify equivalence ratio, the change in flame position must be measured.

Figure 4:
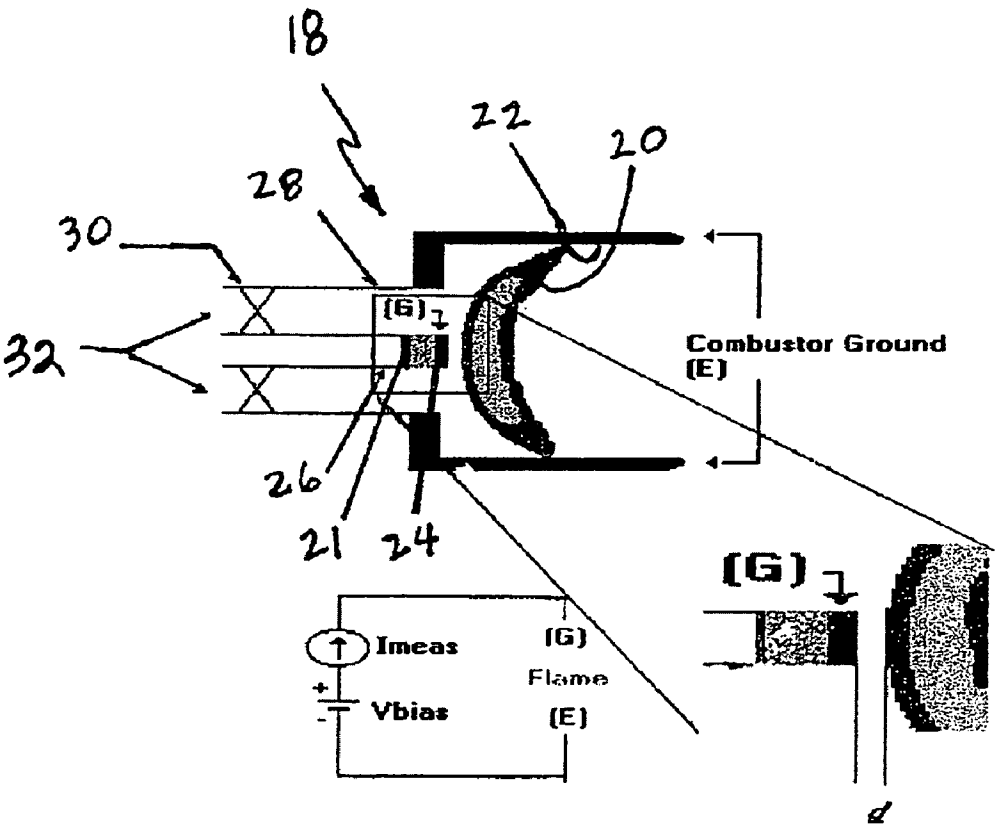
FIG. 4 is a sectional view of the fuel nozzle and combustion chamber portions of a gas turbine combustion system illustrating the distance d between the combustion control and diagnostic sensor and the flame, as well as the equivalent AC circuit.

For example, consider a continuous stable flame 20 located at distance d from an electrode 24 as shown in FIG. 4, which is a sectional view of the fuel nozzle 28 and combustion chamber 22 portions of a gas turbine system illustrating the distance d between the combustion control and diagnostics sensor 18 and the flame 20, as well as the equivalent electric circuit. The combustion sensor 18 is comprised of a first electrode 24 (guard) and a second electrode 21 (sense). Combustion chamber 22 is representative of lean premix combustion chambers for use with the combustion sensor 18. Multiple combustion chambers may be incorporated in the lean premix system, with each combustion chamber provided with its own combustion sensor. For simplicity of discussion, only combustion chamber 22, fuel nozzle 28, and swirl vanes 30 are shown in FIG. 4. Fuel nozzle 28 is connected to a compressor section (not shown) at one end and at a second opposed end to the combustion chamber 22 for delivering a lean fuel/air mixture to the combustion chamber. Swirl vanes 30 are positioned proximate to an inlet section of the fuel nozzle 28 and serve to provide for the thorough burning of the fuel/air mixture within a combustion zone within the combustion chamber 22 by ensuring that the fuel/air mixture is well blended thereby producing the most uniform possible combustion. In most cases, air as the oxidant and gaseous fuel are initially mixed in the pre-mixer section near the inlet of fuel nozzle 28. The fuel/air mixture is then injected into the combustion zone within the combustion chamber 22 through nozzle outlet ports leading into the combustion chamber. An ignition source (also not shown) ignites the fuel/air mixture thereby initiating the combustion process 20, or flame. The first guard electrode 24 is disposed in a nozzle centerbody 26 within the fuel nozzle 28.

The current can be described by modifying Eq. 4 to account for the changes in the electric field. The drift velocity is the product of the mobility of the charged species (μ) and the electric field (E). So Eq. 4 is modified to adjust the electric field based on the flame position (d)

$$I=n\cdot q\cdot A\cdot \mu\cdot E(d) \quad (6)$$

The charge carrier density n represents the number of ions and electrons per unit volume within the measurement volume and is expressed as $$n=\frac{FuelFlow}{TotalFlow}\cdot\frac{P}{R\cdot T}\cdot Na\cdot B \quad (7)$$

where the ratio of fuel volume flow to total volume flow (air+fuel) is determined at operating pressure (P), and temperature (T) of the premixed gas stream, with Na representing Avogadro's number, B is the ion production rate per molecule of fuel, and R is the universal gas constant. In theory, the equivalence ratio can be calculated from the measured air and fuel flows. However, in industrial applications the air flow from the compressor is generally known with only limited accuracy, which may not be sufficient for the desired accuracy of control of the equivalence ratio in the combustor. In addition, fuel injector wear and size variations add uncertainty to the measurement of fuel flow to the combustor.

To determine the electric field at distance d, a time-varying voltage is applied to the sensor electrodes and the resulting current between the two sensor electrodes or between the two sensor electrodes and a grounded surface, such as the combustor ground shown in FIG. 4, can be used to determine a resistance and reactance of the combustion system. The reactance is affected by the capacitance between the flame and the guard electrode. The capacitance measurement can be used to determine the approximate location of the flame, and the electric field applied in the basic conductor theory can now be adjusted based on the flame location and the equivalence ratio can be calculated from the average current measurement.

Signal Analysis Methods

Figure 5:
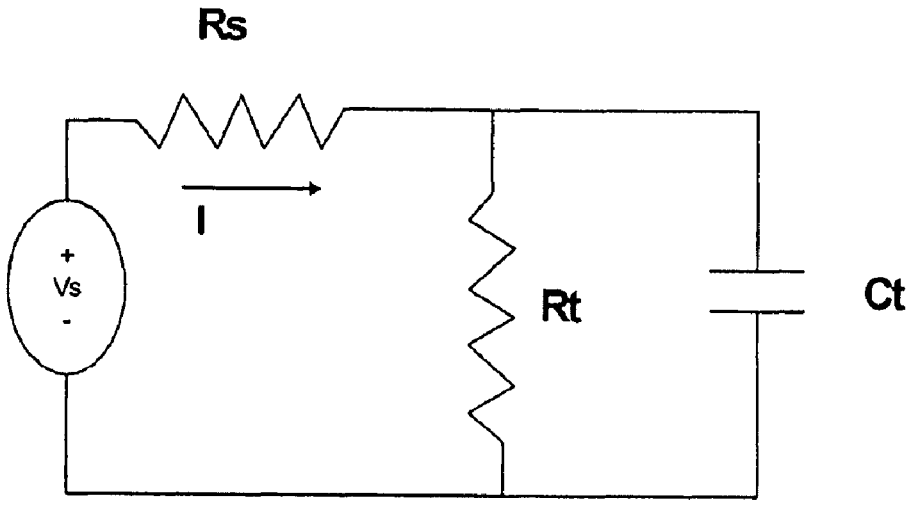
FIG. 5 is a schematic diagram of an AC equivalent circuit for use in combustion control and diagnostics sensor measurements in accordance with one embodiment of the present invention.

The analysis techniques summarized herein employ an equivalent circuit for measurements in the form of a parallel RC circuit, as shown in FIG. 5. The capacitance measurement can be extracted from each time-varying signal with reasonable accuracy using basic circuit analysis techniques.

For the pulsed DC signal, the voltage time lag τ is defined as $$\tau=R*C \quad (6)$$

where R is the resistance and C is the capacitance in a parallel RC circuit. The resistance R can be measured at low frequencies using the measured current at 5 times the time lag, when the current through the capacitor has decreased to negligible levels (approximately zero). The capacitance is calculated using Equation 6 with the measured time lag and calculated resistance.

For a triangle wave, the equation for current i through a parallel RC circuit is given by the following equation:

$$i = \frac{V}{R} + C\left(\frac{dV}{dt}\right) \tag{7}$$

which can be used to determine the resistance R and capacitance C. The rate of change of the voltage dV/dt is constant, and when the voltage equals zero (i.e., crosses zero potential), the current through the resistor is zero. Therefore, when V=0 the capacitance C is given by the following equation $$C = \frac{i}{\left(\frac{dV}{dt}\right)} \tag{8}$$

The resistance can be calculated using Eq. 7, with the calculated capacitance and the measured current during the same cycle close to the peak voltage to ensure maximum field strength.

For the AC analysis, the magnitude and phase angle of the voltage and current are used to calculate the magnitude and phase of the complex impedance. The complex impedance is comprised of a real and an imaginary component. The imaginary, or reactive, component of the complex impedance is related to the capacitance. The capacitive reactance Xc is defined as $$Xc = \frac{1}{2\pi fC} \tag{9}$$

where f is the frequency of the AC signal and C is the capacitance. The resistance R and reactance Xc comprise the impedance Z given by the following equation $$Z^2 = R^2 + Xc^2 \tag{10}$$

where the vector form can be represented as a triangle and the standard trigonometric relationships may be used to calculate the resistance and reactance from the complex impedance. The phase angle between the current and voltage is measured to determine the phase angle of the complex impedance. A DC offset may be added to the AC signal to provide additional information on the combustion process.

Figure 6:
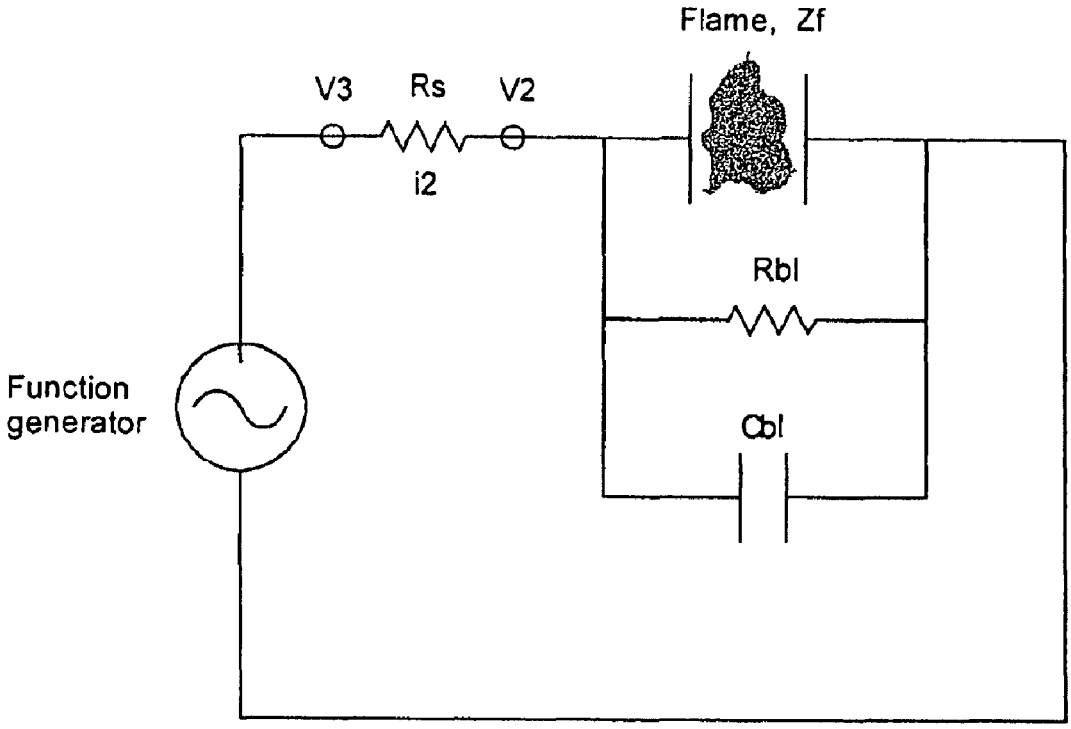
FIG. 6 is an equivalent AC circuit for use in the combustion control and diagnostic sensor measurements in accordance with another embodiment of the present invention, wherein a shunt resistor $R_S$ is used for current measurements, and the capacitance and resistance of other components and connections within the system are respectively denoted as $C_{bl}$ (baseline capacitance) and $R_{bl}$ (baseline resistance)

To determine flame location from the measured capacitance, the equivalent circuit model for the system must be expanded to include resistance and capacitance associated with other components and connections throughout the system. For simplification, these components are represented by a parallel RC section in the equivalent circuit model shown in FIG. 6 and are denoted as $R_{bl}$ (baseline resistance) and $C_{bl}$ (baseline capacitance). These values are measured before igniting the combustor and the assumption for data analysis is that these values remain constant throughout the test. In FIG. 6 the shunt resistor Rs is used for current measurements, and the remaining circuit represents the flame resistance $R_f$ and the space between the flame and the guard electrode $C_d$. By measuring the baseline impedance $Z_{bl}$, and assuming the baseline values remain constant, the total impedance $Z_{bl}$, can be calculated using the relationship $$Z_t = \frac{Z_{bl} Z_f}{Z_{bl} + Z_f} \tag{11}$$

and the gap-flame region impedance $Z_f$ is approximated as a series combination of the gap capacitance ($C_g$) and the flame resistance ($R_f$) by the following equation $$Z_f = R_f + \frac{1}{j\omega C_g} \tag{12}$$

This capacitance measurement is directly related to the distance of the flame from the fuel injector exit as shown in FIG. 4. One can consider the parallel plate capacitor theory similar to the proposed application theory, and it is therefore useful to illustrate this concept. The capacitance $C_g$ of a parallel plate capacitor is given by the following equation $$C_g = \frac{k \cdot \varepsilon_0 \cdot A}{d} \tag{13}$$

where k is the dielectric constant of the material between the two plates which are of area A and are separated by a distance d, and $\in_o$, is the permittivity of free space ($8.854\times10^{-12}$ $C^2/Nm^2$).

Figure 7A:
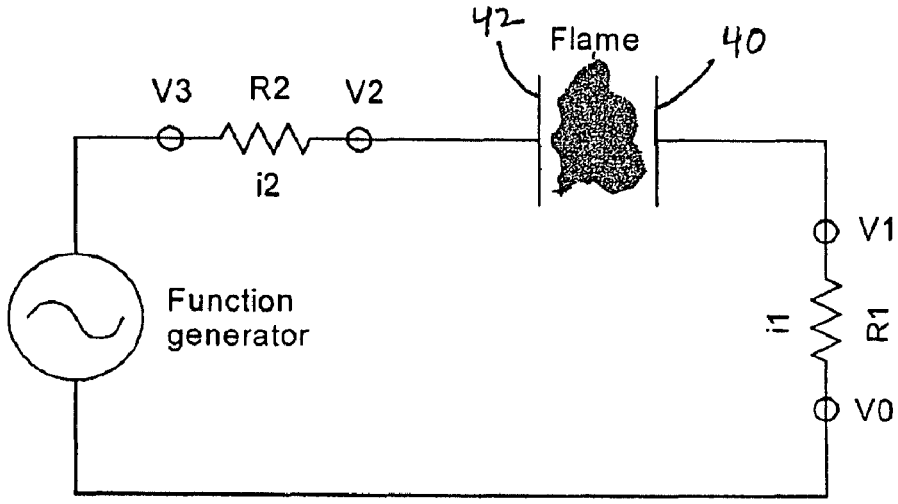
FIG. 7*a* is an AC equivalent circuit diagram for the configuration of a function generator with series resistors connected to measurement electrodes to measure the current through the gap-flame region in accordance with the an embodiment of the invention.
Figure 7B:
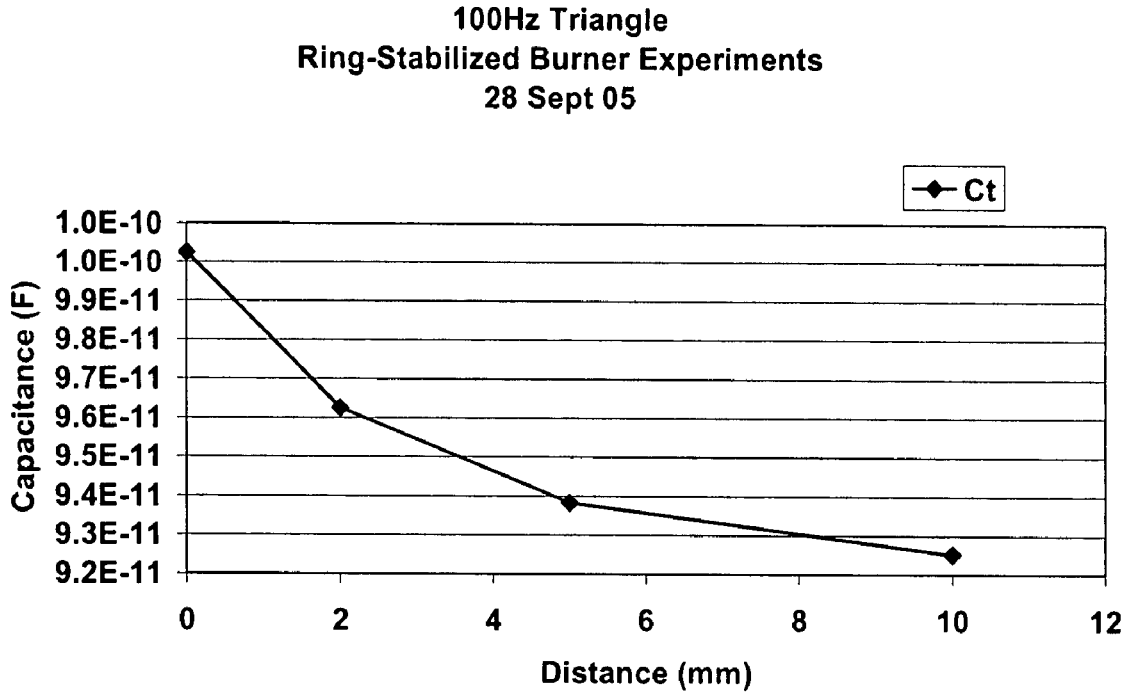
FIG. 7*b* is a graphic illustration of the decrease in capacitance as the flame is moved away from the measurement electrode for the system corresponding to the equivalent AC circuit shown in FIG. 7*a;*
Figure 8:
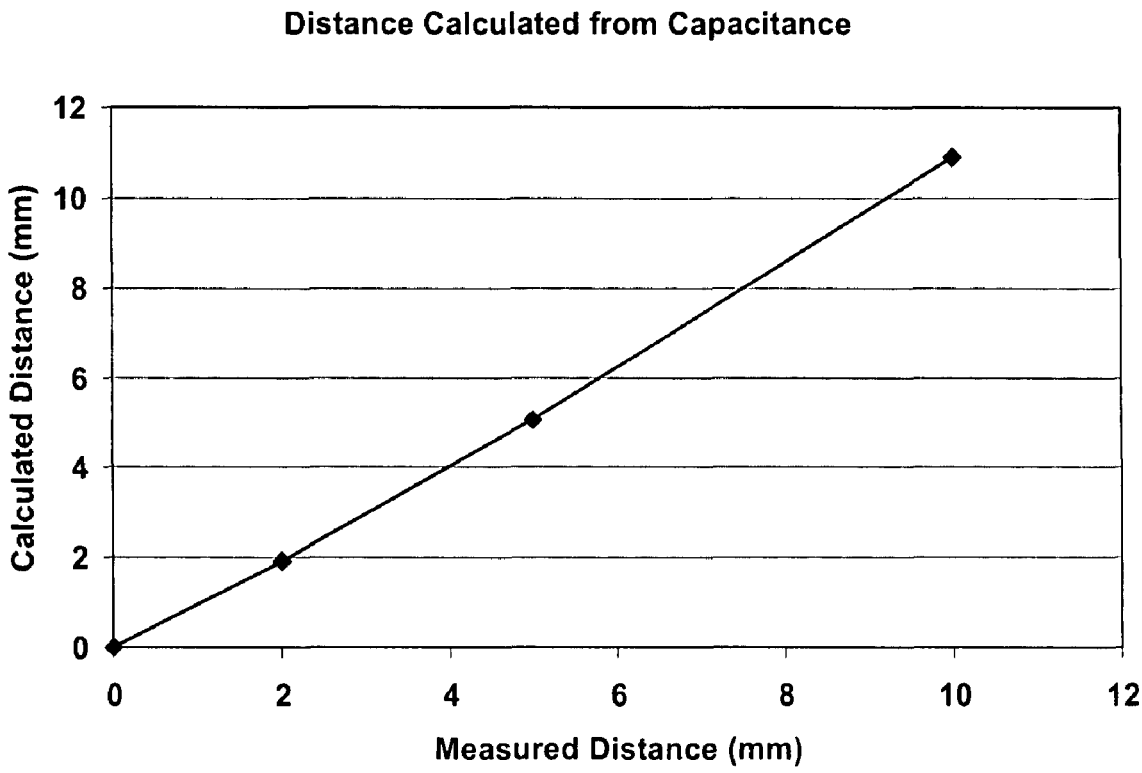
FIG. 8 is a graphic comparison of actual flame distance from the sensor's electrode versus calculated distance from the circuit capacitance using the equivalent AC circuit of FIG. 7*a;*

A laboratory experiment was conducted to examine the change in capacitance as the flame moves away from the electrode. The experiment involved using a ring-stabilized flame burner, with an electrically isolated ring for flame stabilization and movement. The ring-stabilizer is moved away from the electrode with a translation stage, resulting in the flame moving away from the measurement electrode. FIG. 7*a* illustrates the configuration of a function generator with series resistors R1 and R2 respectively connected to measurement electrodes 40 and 42 to measure the current through the gap-flame region. The data graphically presented in FIG. 7*b* illustrates a decrease in capacitance as the flame is moved away from the measurement electrode. This confirms the inverse relationship between capacitance and distance. The data in Table 1 illustrates the change in capacitance with a change in flame-electrode distance d from 0 mm to 10 mm. To calculate the distance d, the dielectric constant for methane (1.7) and the area of the electrode (radius=0.0127 m) were used in Eq. 13. The calculated distance agrees well with the actual distance, as shown in FIG. 8.

TABLE 1

| Distance (mm) | Delta Capacitance (F) | Calculated Distance (mm) |
|---|---|---|
| 0 | 0 | 0 |
| 2 | −3.99E−12 | 1.91 |
| 5 | −2.42E−12 | 5.06 |
| 10 | −1.30E−12 | 10.89 |

Figure 9:
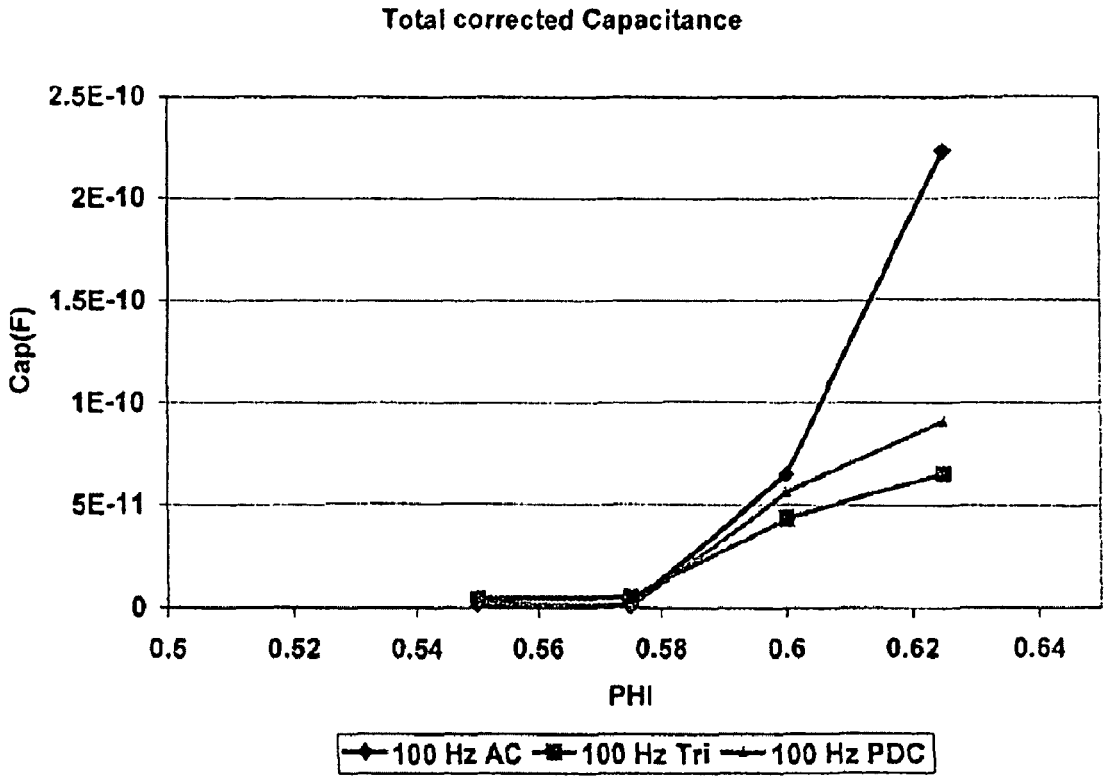
FIG. 9 is a graph showing the equivalence ratio (PHI) in terms of the capacitance based upon testing in the pressurized pulsed combustor (PPC) at the National Energy Technology Laboratory (NETL)

In addition to providing the capability to determine the electrode to flame distance, the ability to measure the capacitance of the flame also provides an alternative approach to determination of the equivalence ratio. This has been demonstrated from analysis of data from tests in the pressurized pulsed combustor (PPC) at NETL as shown in FIG. 9 which is a graph showing the equivalence ratio (PHI) in terms of the capacitance based upon testing in the PPC at NETL.

Figure 10:
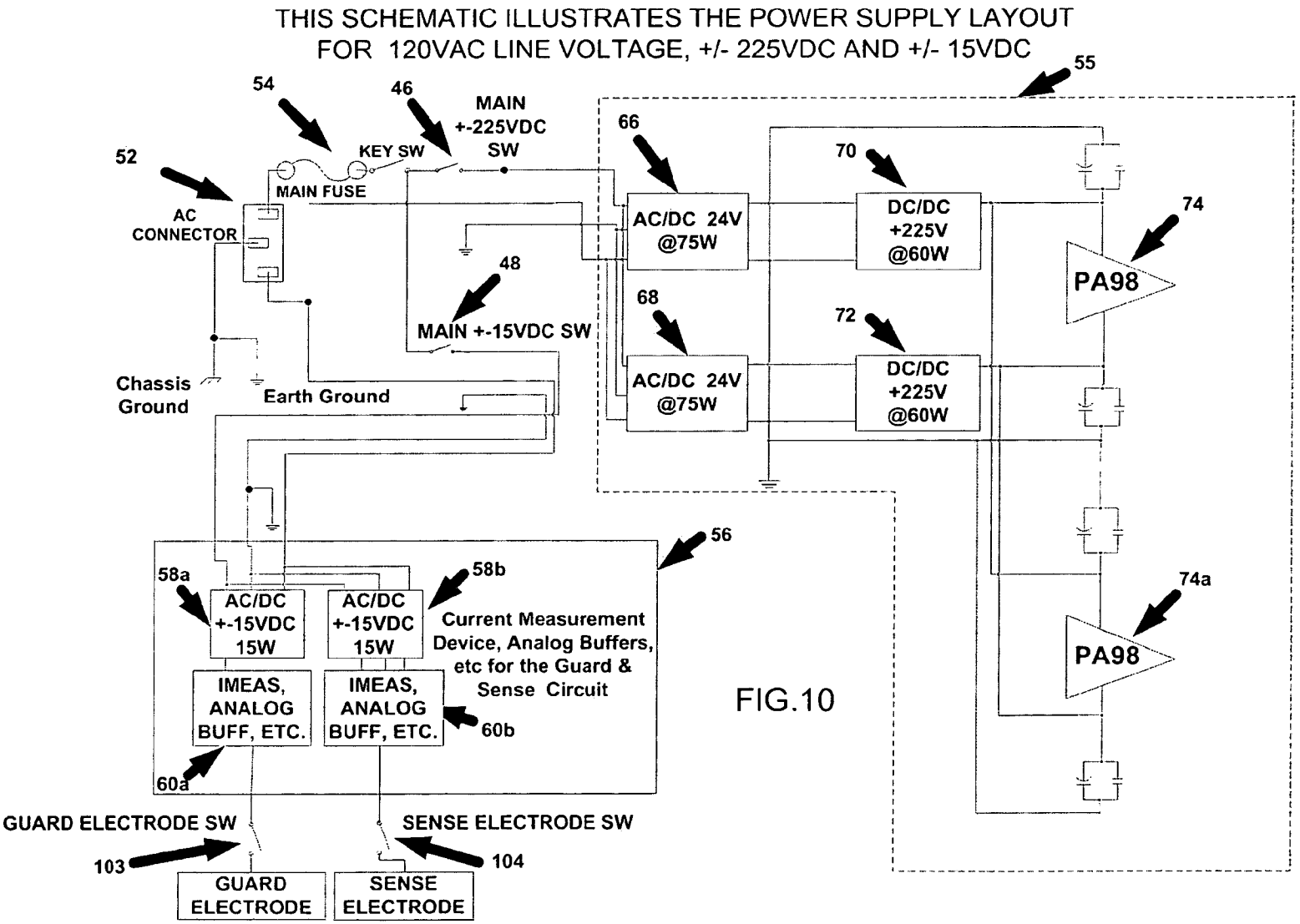
FIG. 10 is a combined schematic and block diagram of a power supply for use with the real-time combustion control and diagnostics sensor of the invention.

Referring to FIG. 10, there is shown a multi power supply layout for use with the real-time combustion control and diagnostic sensor of an embodiment of the invention. Power supplies 66, 68, 58*a* and 58*b* are connected to an AC outlet (not shown) by means of a 3-prong plug 52, which is connected to all AC to DC conversion type power supplies via a safety fuse 54. A first switch 46 allows for the activation of the high voltage circuitry by activating power supplies 66, 68, 70 and 72. A second switch 48 activates power supplies 58*a* and 58*b* to provide power for actuation of a current measurement circuit 56 that measures the current in a flame within the combustion chamber. Power supplies 58*a* and 58*b* are each an AC to DC converter that provides 15 Watts, +/−15 VDC at 1 amp to the guard and sense electrode current measurement devices, as well as to other devices needing +/−15 VDC such as analog buffers located in elements 60*a* and 60*b*. The current measurement circuit 56 measures the electrical current within the flame in multiple ways utilizing the guard and sense electrodes and ground. Switch 103 disconnects the multi power supply layout from the guard electrode and switch 104 disconnects the multi power supply layout from the sense electrode.

Power supplies 66 and 68 within a voltage conversion circuit 55 are also in the form of AC to DC converters. Both AC to DC converters 66 and 68 are enclosed 175 KHz switching power supplies, which provide 75 Watts at 24 Volts maximum power. The outputs of the first and second AC to DC converters 66 and 68 are respectively provided to first and second DC to DC converters 70 and 72 with the necessary wattage and voltage to supply +/−225 VDC.

Figure 11:
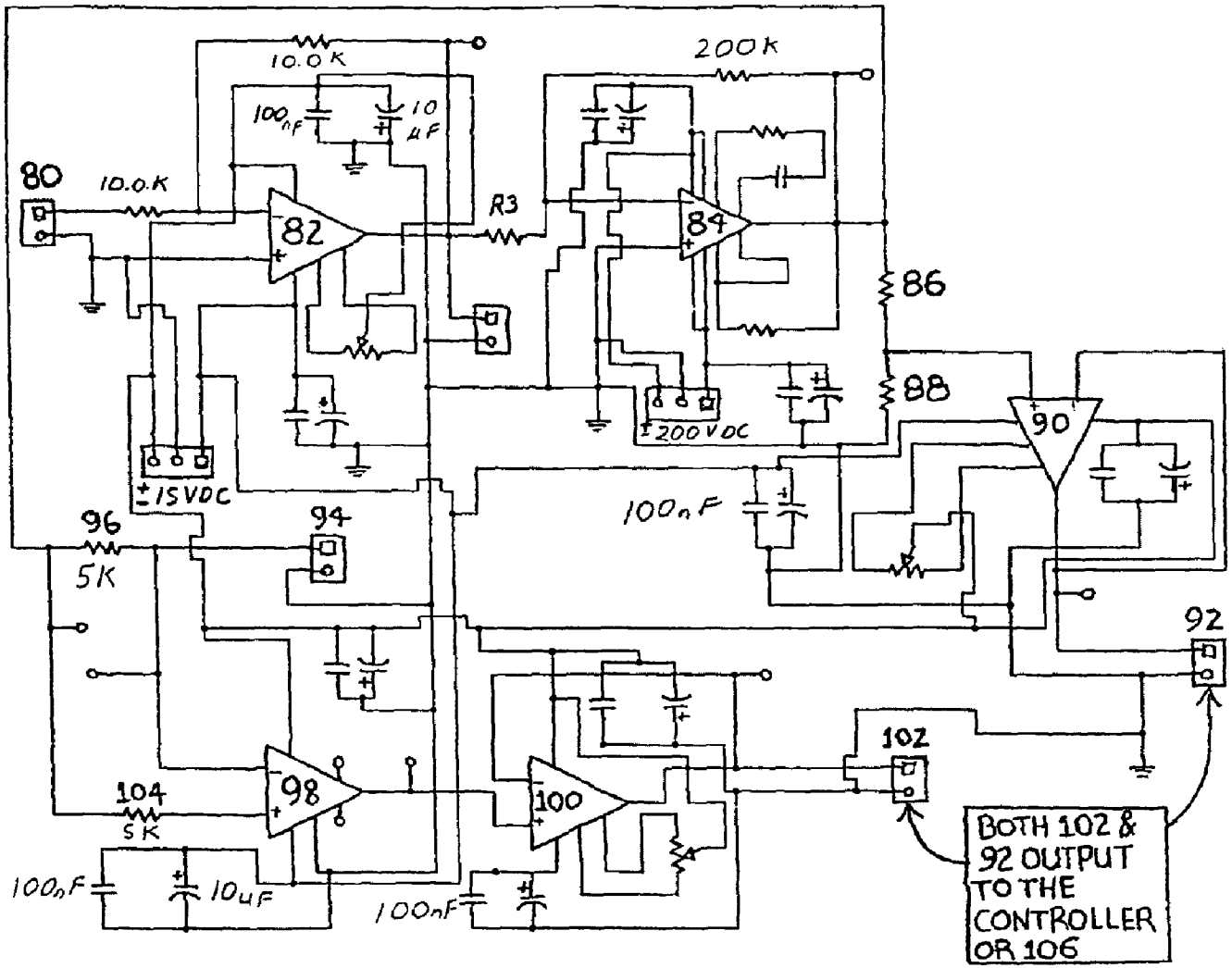
FIG. 11 is a schematic diagram of an interface circuit for use between the power supply shown in FIG. 10 and the real-time combustion control and diagnostics sensor of the invention.

The outputs of the first and second DC to DC converters 70 and 72 are provided to both integrated circuits 74 and 74*a*, which is shown in detail in FIG. 11. Integrated circuits 74 and 74*a* both receive the high voltage DC outputs from the first and second DC to DC converters 70, 72 as a supply voltage to power the integrated circuit. The integrated circuit also receives a signal from an outside source and converts this signal into voltages usable by the guard and sense electrodes of the real-time combustion control and diagnostic sensor of the present invention.

Referring to the schematic diagram of FIG. 11, there are shown additional details of the multi power supply layout of FIG. 10. An embodiment of the invention employs two circuits such as shown in FIG. 11, with one circuit associated with the sensor's guard electrode and the other circuit associated with the sensor's sense electrode. Only one of these circuits is discussed herein for simplicity. A 10 V input is provided to a first amplifier 82 via an input connector 80. The first amplifier 82, in combination with its associated circuitry, provides a buffered voltage signal to a second amplifier 84. The second amplifier 84 amplifies the 10V input to a 200 V output signal which is stepped down by resistor 86 and 88 and is provided to a third amplifier 90. The output voltage of the third amplifier 90 is provided via an output connector 92 to a system air/fuel controller 106. The output voltage from the second amplifier 84 is also provided via a resistor 96 to a second output connector 94, which is connected to a sensor electrode. Resistor 96 serves as a shunt and is used to measure the current in the flame using a fourth amplifier 98. Resistor 104 also connected to the fourth amplifier 98 is used to balance the inputs of the amplifier which measures the current through resistor 96, which corresponds to the current within the flame. The output of the fourth amplifier 98 represents the current within the flame and is provided to a fifth amplifier 100 which serves to buffer this signal and is connected to an output connector 102. Output connector 102 is also connected to the system air/fuel controller 106.

The present invention also provides a self-diagnostics capability for the sensor used in the real-time combustion control and monitoring system. In the prior art approach wherein a DC current in the combustion flame is measured, the saturation of a DC current indicates a short circuit in the sensor such as in the case of an electrode becoming electrically connected to ground through a loose lead wire which contacts an electrically grounded surface, or contamination (e.g. Soot) bridging the electrical insulation between electrodes and ground. Other sensor faults are incapable of being detected in the prior art DC approach. However, the measurement of capacitance within a combustion flame in an embodiment of the invention allows for detection of not only a short circuit in the electrode, but also various other faults such as an open circuit situation as in the case of a poor or severed connection between an electrode and other sensor circuit components. In an embodiment of the invention, a substantial reduction in the measured capacitance such as due to a fault in the sensor circuit or a problem with the sensor electrode is recognized and identified as a system fault. In addition, the prior art DC approach measures only the resistance of the combustion flame and is capable of only limited monitoring of the combustion flame. By measuring the resistance and capacitance of the combustion flame, an embodiment of the invention provides improved sensing and monitoring of many more combustion parameters than available in the prior art DC approach.

While particular embodiments of an embodiment of the invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A system for the real-time monitoring and control of a combustion process in the combustion zone of an industrial combustion chamber, wherein a fuel/oxidant mixture source provides a lean fuel/oxidant mixture characterized by a fuel/oxidant ratio for ignition and maintaining a combustion flame in the combustion zone during operation of the industrial combustion chamber, the system comprising:

a sensor having a first electrode disposed adjacent the combustion zone;

a ground electrode, the ground electrode disposed in the combustion zone and in spaced-apart relation to the first electrode;

a voltage source for applying a time-varying voltage between the first electrode and the ground electrode and inducing a time-varying current between the first electrode and the ground electrode;

circuit means for measuring the time-varying current;

means for applying equivalent AC circuit analysis to an equivalent AC circuit and the time-varying current for determining the magnitude and phase angle of a voltage within the combustion flame using the time-varying current, and means for using the magnitude and phase angle of the voltage within the combustion flame to determine a complex impedance of the combustion flame, and means for determining a distance d of the combustion flame from the first electrode and determining the fuel/oxidant ratio of the fuel/oxidant mixture using the complex impedance of the combustion flame; and a controller coupled to the fuel/oxidant mixture source and responsive to the distance d and the fuel/oxidant ratio determined using the complex impedance of the combustion flame for adjusting the fuel/oxidant mixture and the distance d for optimizing the combustion process by reducing flame instability and pollutant emissions.

2. The system of claim 1 wherein the oxidant is air.

3. The system of claim 1 wherein the equivalent AC circuit represents the combustion flame as resistance only, and the equivalent AC circuit represents the distance d between the first electrode and the combustion flame as capacitance only.

4. The system of claim 3 wherein the equivalent AC circuit includes a baseline resistance and a baseline capacitance respectively corresponding to the resistance and capacitance of other components and connections within the industrial combustion chamber and the sensor.

5. The system of claim 4 wherein the baseline resistance and the baseline capacitance are arranged in parallel with each other and with the combustion flame in the equivalent AC circuit.

6. The system of claim 3 further comprising means for diagnosing a fault in the sensor by measuring the time-varying current, and using the equivalent AC circuit to determine a capacitance and resistance of the flame and sensor, and comparing the capacitance of the flame and sensor with the known baseline capacitance of the sensor only, and determining if the capacitance of the flame and sensor is indicative of the fault in the sensor.

7. The system of claim 6 further comprising means for comparing the resistance of the flame and sensor with an expected range to detect a short circuit, and using the capacitance of the flame and sensor to confirm the fault in the sensor.

8. The method of claim 6 further comprising means for measuring the time-varying current at a plurality of time-varying voltages, and determining if the time-varying electric currents indicate that a short circuit has occurred.

9. The system of claim 1 wherein the first electrode of the sensor defines an axis extending into the combustion flame, and wherein the distance d is measured along the axis.

10. The system of claim 1 wherein the time-varying voltage is an alternating voltage and the time-varying current is an alternating current.

11. The system of claim 1 wherein the time-varying voltage is a square wave.

12. The system of claim 1 wherein the time-varying voltage is a triangle wave.

13. A method for the real-time monitoring and control of a combustion process in the combustion zone of a combustion chamber, wherein a fuel/oxidant mixture characterized by a fuel/oxidant ratio is directed into the combustion zone via a fuel/oxidant inlet and is ignited for maintaining a combustion flame in the combustion zone, the method comprising the steps of:

providing a sensor having a first electrode and a ground disposed adjacent the combustion zone, wherein the combustion flame is disposed a distance d from the first electrode;

applying a time-varying voltage to the first electrode and measuring a time-varying electric current between the first electrode and the ground, wherein the time-varying electric current varies with the position of the combustion flame from the first electrode within the combustion zone along a sensor axis;

using equivalent AC circuit analysis with an equivalent AC circuit and with the time-varying electric current between the first electrode and the ground to determine the magnitude and phase angle of a voltage within the combustion flame, and using the magnitude and phase angle of the voltage within the combustion flame to determine a complex impedance of the combustion flame;

determining the distance d of the combustion flame from the first electrode and determining the fuel/oxidant ratio of the fuel/oxidant mixture using the complex impedance of the combustion flame; and adjusting the fuel/oxidant mixture for adjusting the distance d and the fuel/oxidant ratio for optimizing the combustion process by reducing flame instability and pollutant emissions.

14. The method of claim 13 where the oxidant is air.

15. The method of claim 13 wherein the equivalent AC circuit represents the combustion flame as resistance only, and the equivalent AC circuit represents the distance d between the first electrode and the combustion flame as capacitance only.

16. The method of claim 13 wherein the equivalent AC circuit further includes a baseline resistance and a baseline capacitance respectively corresponding to the resistance and capacitance of other components and connections within the combustion chamber and the sensor.

17. The method of claim 16 wherein said baseline resistance and baseline capacitance are arranged in parallel with each other and with the combustion flame in the equivalent AC circuit.

18. The method of claim 16 further comprising the steps of diagnosing a fault in the sensor by measuring the time-varying electric current in the combustion flame between the first electrode and ground.

19. The method of claim 18 further comprising the step of using the equivalent AC circuit to determine a capacitance of the flame and sensor and a resistance of the flame and sensor.

20. The method of claim 19 further comprising the step of comparing the capacitance of the flame and sensor with the known baseline capacitance of the sensor only, and determining if the capacitance of the flame and sensor is indicative of the fault in the sensor.

21. The method of claim 19 further comprising the step of comparing the resistance of the flame and sensor with an expected range to detect a short circuit, and using the capacitance of the flame and sensor to confirm the fault in the sensor.

22. The method of claim 18 further comprising the step of measuring the time-varying electric current at a plurality of time-varying voltages, and determining if the time-varying electric currents indicate that a short circuit has occurred.

23. The method of claim 13 wherein the first electrode defines an axis extending into the combustion flame, and wherein the distance d is measured along the axis.

24. The method of claim 13 wherein the time-varying voltage is an alternating voltage and the time-varying electric current is an alternating current.

25. The method of claim 13 wherein the time-varying voltage is a square wave.

26. The method of claim 13 wherein the time-varying voltage is a triangle wave.

27. The method of claim 13 wherein the time-varying voltage has a DC offset voltage.

28. The method of claim 13 where the fuel/oxidant ratio of the fuel/oxidant mixture is determined by further using the distance d.

29. The method of claim 13 where the equivalent AC circuit approximates the complex impedance of the combustion flame as a flame resistance having electrical resistance only, and where the equivalent AC circuit approximates a complex impedance of the distance d between the first electrode and the combustion flame as a gap capacitance having electrical capacitance only, and where the flame resistance and the gap capacitance are in series, and where the equivalent AC circuit further includes a baseline resistance and a baseline capacitance respectively corresponding to the resistance and capacitance of other components and connections within the combustion system.

30. The method of claim 13 where the ground is a virtual ground with respect to the first electrode.

31. The method of claim 13 where the ground is an electrical ground with respect to the combustion chamber.

32. A method for the real-time monitoring and control of a combustion process in the combustion zone of a combustion chamber, wherein a fuel/oxidant mixture characterized by a fuel/oxidant ratio is directed into the combustion zone via a fuel/oxidant inlet and is ignited for maintaining a combustion flame in the combustion zone, the method comprising the steps of:

providing a sensor having a first electrode and a ground disposed adjacent the combustion zone, wherein the combustion flame is disposed a distance d from the first electrode;

applying a time-varying voltage to the first electrode and measuring a time-varying current between the first electrode and the ground, wherein the time-varying current varies with the position of the combustion flame from the first electrode within the combustion zone along a sensor axis;

using equivalent AC circuit analysis with an equivalent AC circuit and with the time-varying current between the first electrode and the ground to determine the magnitude and phase angle of a voltage within the combustion flame and the magnitude and phase angle of a voltage across the distance d, where the equivalent AC circuit represents the combustion flame as resistance only, and where the equivalent AC circuit represents the distance d between the first electrode and the combustion flame as capacitance only, and where the equivalent AC circuit includes a baseline resistance and a baseline capacitance respectively corresponding to the resistance and capacitance of other components and connections within the combustion system, and where the equivalent AC circuit places the distance d and the combustion flame in series, and places the baseline resistance and the baseline capacitance in parallel with each other and with the distance d and the combustion flame;

using the magnitude and phase angle of the voltage within the combustion flame to determine a complex impedance of the combustion flame;

using the magnitude and phase angle of the voltage across the distance d to determine the distance d, and determining the fuel/oxidant ratio of the fuel/oxidant mixture using the complex impedance of the combustion flame; and adjusting the fuel/oxidant mixture for adjusting the distance d and the fuel/oxidant ratio for optimizing the combustion process by reducing flame instability and pollutant emissions.

33. The method of claim 32 where the oxidant is air.

34. The method of claim 32 where the time-varying voltage is an alternating voltage and the time-varying current is an alternating current.

35. The method of claim 34 where the time-varying voltage is a square wave.

36. The method of claim 34 where the time-varying voltage is a triangle wave.

37. The method of claim 34 where the time-varying voltage has a DC offset voltage.

38. The method of claim 32 further comprising the step of diagnosing a fault in the sensor by comparing the voltage within the combustion flame with an expected range.

39. The method of claim 32 further comprising the step of diagnosing a fault in the sensor by comparing the voltage across the distance d with an expected range.

* * * * *